US012514302B2

(12) United States Patent
Takii et al.

(10) Patent No.: US 12,514,302 B2
(45) Date of Patent: Jan. 6, 2026

(54) SPORTS BRASSIERE

(71) Applicant: ASICS CORPORATION, Hyogo (JP)

(72) Inventors: Yasuho Takii, Hyogo (JP); Hironori Kitayama, Hyogo (JP)

(73) Assignee: ASICS CORPORATION, Hyogo (JP)

( * ) Notice: Subject to any disclaimer, the term of this patent is extended or adjusted under 35 U.S.C. 154(b) by 0 days.

(21) Appl. No.: 18/599,610

(22) Filed: Mar. 8, 2024

(65) Prior Publication Data

US 2024/0324700 A1 Oct. 3, 2024

(30) Foreign Application Priority Data

Mar. 28, 2023 (JP) ..... 2023-051340

(51) Int. Cl.
*A41C 3/00* (2006.01)

(52) U.S. Cl.
CPC ..... *A41C 3/0057* (2013.01)

(58) Field of Classification Search
CPC ..... A41C 3/0057
USPC ..... 450/81
See application file for complete search history.

(56) References Cited

U.S. PATENT DOCUMENTS 2,289,679 A * 7/1942 Porter ..... A41C 3/144 450/57
2,524,623 A * 10/1950 Colombu ..... B65H 67/056 242/474.9
2,628,356 A * 2/1953 Rosenfield ..... A41C 3/06 450/41
2,988,087 A * 6/1961 Krieger ..... A41C 3/06 450/81
3,254,653 A * 6/1966 Krieger ..... A41C 3/00 450/39
6,332,825 B1 * 12/2001 Henricksen ..... A41F 15/00 450/1
6,446,268 B1 * 9/2002 Lazarian ..... A41F 9/00 427/256

(Continued)

FOREIGN PATENT DOCUMENTS

JP 3079233 U 8/2001
JP 3106186 U 12/2004

(Continued)

OTHER PUBLICATIONS

The Extended European Search Report dated Jul. 18, 2024, from European Patent Application No. 24160169.9, 8 sheets.

*Primary Examiner* — Gloria M Hale
(74) *Attorney, Agent, or Firm* — KATTEN MUCHIN ROSENMAN LLP

(57) ABSTRACT

In a sports brassiere, a side-belt portion connects outer ends of a cup portion in a chest circumference direction of a wearer. A shoulder strap portion connects an upper end of the cup portion and an upper end of the side-belt portion over a shoulder of the wearer. On a surface of the cup portion that faces the breasts, an adhesive member is disposed in a peripheral region excluding a central portion of a circular region facing a breast, with an arrangement pattern for restraining movement of the breast on a lower side and a side. The arrangement pattern is a pattern with which an adhesive member is disposed along a diagonal region from below the central portion toward an upper part of a side, on the surface of the cup portion that faces the breasts.

19 Claims, 16 Drawing Sheets

(56) References Cited

U.S. PATENT DOCUMENTS

| | | | | |
|---|---|---|---|---|
| 6,733,362 | B2 * | 5/2004 | Plew | A41C 3/00 450/86 |
| 7,051,557 | B2 * | 5/2006 | Mitchell | D04B 1/106 450/92 |
| 7,422,508 | B2 * | 9/2008 | Bentham | A41C 3/0014 2/243.1 |
| 8,480,452 | B2 * | 7/2013 | Reinisch | A41C 3/0057 450/39 |
| 8,647,169 | B2 | 2/2014 | Chang | |
| 8,684,789 | B2 * | 4/2014 | Gramelspacher | A41C 3/065 450/92 |
| 9,402,424 | B2 * | 8/2016 | Roy | A41C 5/005 |
| 9,516,905 | B2 * | 12/2016 | Pagnon | A41C 3/10 |
| 9,565,877 | B2 * | 2/2017 | Martinet | A41C 3/065 |
| 10,123,575 | B2 * | 11/2018 | Funk-Danielson | A41C 3/0057 |
| 10,231,492 | B1 * | 3/2019 | Bastug | A41C 3/10 |
| 10,721,974 | B2 * | 7/2020 | Bastug | A41C 3/0057 |
| 2005/0266770 | A1 | 12/2005 | Henricksen | |
| 2009/0098803 | A1 * | 4/2009 | Reinisch | A41C 3/0014 450/86 |
| 2011/0143633 | A1 | 6/2011 | Zhang | |
| 2012/0122371 | A1 * | 5/2012 | Reinisch | A41C 3/0014 450/93 |
| 2018/0279692 | A1 * | 10/2018 | Witek | A41C 5/00 |
| 2019/0174841 | A1 * | 6/2019 | Bastug | A41C 3/0007 |

FOREIGN PATENT DOCUMENTS

| | | | |
|---|---|---|---|
| JP | 2005-113280 | A | 4/2005 |
| JP | 2005-126850 | A | 5/2005 |
| JP | 3688701 | B1 | 8/2005 |
| JP | 2010-248646 | A | 11/2010 |
| JP | 2012-167415 | A | 9/2012 |
| JP | 3185931 | U | 9/2013 |
| JP | 2020-056146 | A | 4/2020 |
| JP | 2022-018049 | A | 1/2022 |

* cited by examiner

SPORTS BRASSIERE

REFERENCE TO RELATED APPLICATIONS

This application claims the benefit of priority from the prior Japanese Patent Application No. 2023-051340 filed with Japan Patent Office on Mar. 28, 2023, the entire contents of which are incorporated herein by reference.

BACKGROUND

1. Technical Field

The present disclosure relates to brassieres, and particularly to a technology for sports brassieres.

2. Background Information

A brassiere is worn on the chest to cover and protect the breasts and assists the wearer's movement by moderately maintaining the positions and shapes of the breasts. Known conventional brassieres include those with means such as wires and pads to support the breasts (see Patent Literature 1, for example) and those with an adhesive substance applied to the entire inner surface of the cups to eliminate the need for shoulder straps (see Patent Literatures 2-7, for example). For sports brassieres worn during exercise, in order to restrain swaying and movement of the breasts, which is stronger than that during non-exercise time, many types of such brassieres are each made to tightly press the cups onto the breasts by means of an underbelt.

RELATED-ART LITERATURE AND PATENT LITERATURE

Patent Literature 1: Japanese Unexamined Patent Application Publication No. 2022-018049

Patent Literature 2: Japanese Unexamined Patent Application Publication No. 2012-167415

Patent Literature 3: Japanese Patent No. 3688701

Patent Literature 4: Japanese Unexamined Patent Application Publication No. 2005-126850

Patent Literature 5: Japanese Unexamined Patent Application Publication No. 2005-113280

Patent Literature 6: Japanese Unexamined Patent Application Publication No. 2020-056146

Patent Literature 7: Japanese Unexamined Patent Application Publication No. 2010-248646.

Patent Literature 8: Japanese Examined Utility Model Registration No. 3185931

Patent Literature 9: Japanese Examined Utility Model Registration No. 3079233

Patent Literature 10: Japanese Examined Utility Model Registration No. 3106186

However, depending on the tightening strength of the underbelt, an oppressive feeling due to the compression to the chest could be significant, which may cause a feeling of suffocation especially during cardiopulmonary exercise. Conversely, if the underbelt is designed to be looser with weakened compression, the brassiere may shift or rub against the skin during exercise, which may cause discomfort.

SUMMARY

The present disclosure has been made in view of such an issue, and a purpose thereof is to provide a sports brassiere that achieves both the restraint of swaying of the breasts and ease of breathing for the wearer during exercise.

In response to the above issue, a sports brassiere according to one embodiment of the present disclosure includes a cup portion that covers breasts of a wearer, a side-belt portion that connects outer ends of the cup portion in a chest circumference direction of the wearer, and a shoulder strap portion that connects an upper end of the cup portion and an upper end of the side-belt portion over a shoulder of the wearer. On a surface of the cup portion that faces the breasts, an adhesive member is disposed in a peripheral region excluding a central portion of a circular region facing a breast, with an arrangement pattern for restraining movement of the breast on a lower side and a side.

Another embodiment of the present disclosure also relates to a sports brassiere. The sports brassiere includes a cup portion that covers breasts of a wearer, and a side-belt portion that connects outer ends of the cup portion in a chest circumference direction of the wearer. On a surface of the cup portion that faces the breasts, an adhesive member is disposed along a peripheral region excluding a central portion of a circular region facing a breast, and the peripheral region is a diagonal region located from below the central portion toward an upper part of a side.

Optional combinations of the aforementioned constituting elements, and implementation of the present disclosure, including the constituting elements and expressions, in the form of methods or apparatuses may also be practiced as additional modes of the present disclosure.

BRIEF DESCRIPTION OF THE DRAWINGS

An embodiment will now be described, by way of example only, with reference to the accompanying drawings which are meant to be exemplary, not limiting, and wherein like elements are numbered alike in several figures, in which.

DETAILED DESCRIPTION

Figure 1:
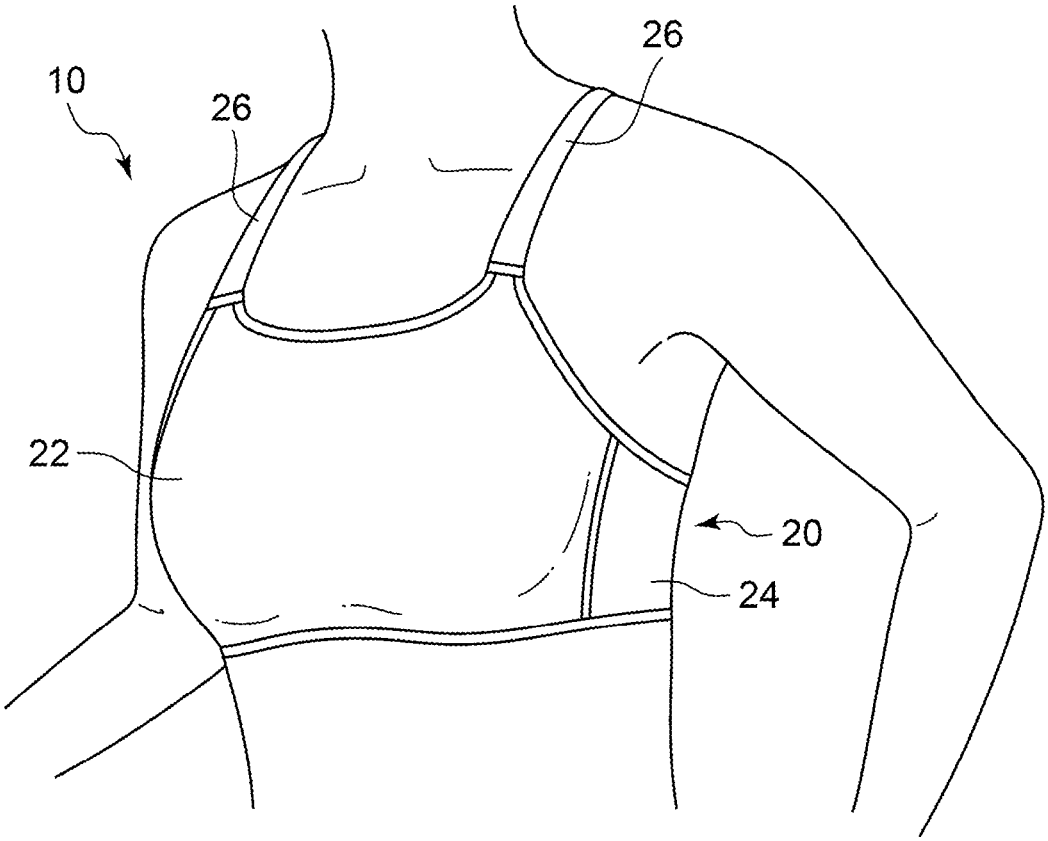
FIG. 1 is a perspective view of a worn state of a brassiere, viewed from the front left side.

In the following, the present disclosure will be described based on a preferred embodiment with reference to the drawings. Like reference characters denote like or corresponding constituting elements and members in each drawing, and repetitive description will be omitted as appropriate. Also, the dimensions of a member may be appropriately enlarged or reduced in each drawing in order to facilitate understanding. Further, in each drawing, part of a member less important in describing the embodiment may be omitted.

Figure 2:
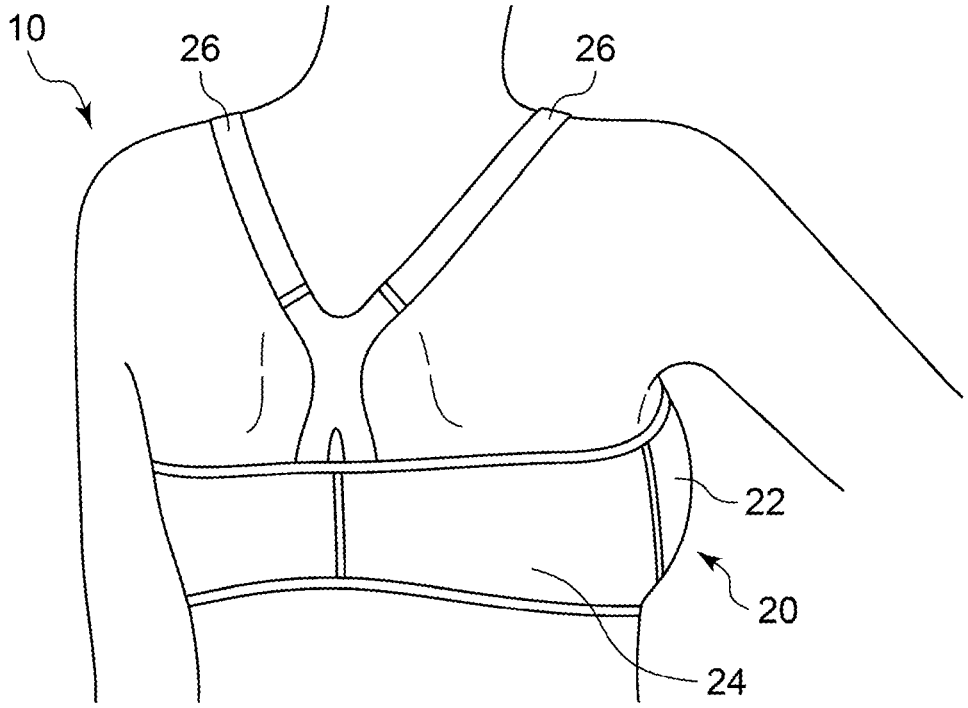
FIG. 2 is a perspective view of a worn state of the brassiere, viewed from the rear right side.

FIG. 1 is a perspective view of a worn state of a brassiere 20, viewed from the front left side. FIG. 2 is a perspective view of a worn state of the brassiere 20, viewed from the rear right side. The brassiere 20 is a sports brassiere designed to be worn during sports, particularly running. In general, sports brassieres are designed to restrain up-and-down, back-and-forth, and side-to-side movement of the breasts, with the wearer's movement in various directions taken into account. In this case, the stronger the tightening, the more effective it is in restraining movement. In particular, many brassieres are each designed to restrain shifting of the brassiere position by strongly tightening the brassiere around the body with a belt called an underbelt for tightening around the chest at the bottom of the brassiere.

The applicant's study has found that, in swaying of a breast during running, the acceleration of movement toward the lower side or the side and the acceleration of movement between a lower part of the breast and an upper part of the side is particularly large. Therefore, the brassiere 20 of the first embodiment is designed, as a running brassiere, to particularly restrain the movement of the breasts of a wearer 10, on the lower side and the sides.

The brassiere 20 includes a cup portion 22, a side-belt portion 24, and a shoulder strap portion 26. The cup portion 22 is formed to include a pair of cup-shaped parts that cover the left and right breasts of the wearer 10. The pair of cup-shaped parts in the cup portion 22 may be formed by molded cups. The cup portion 22 is disposed to wrap the wearer's breasts from a lower part to an upper part and has a three-dimensional shape with bulges toward the front from the chest. The shape and size of the cup portion 22 are determined based on variations of the shapes and sizes of breasts and may suitably be determined such as to reduce differences in compression in a range where the breasts are in contact.

In the cup portion 22, at least the cup-shaped parts are made of a lightweight and flexible material such as polyurethane, and portions other than the cup-shaped parts may also be made of polyurethane. Alternatively, only the portions other than the cup-shaped parts may be made of a more breathable mesh material such as polyester or nylon, or a more stretchable material such as spandex.

The side-belt portion 24 is a portion connecting the left and right outer ends of the cup portion 22 in a chest circumference direction of the wearer 10. The side-belt portion 24 is disposed to connect the left outer end and the right outer end of the cup portion 22, through the left side, the back, and the right side of the wearer 10. The side-belt portion 24 of the first embodiment is configured such that a pair of left and right belts are connected with each other by a hook near the center of the back of the wearer 10. For the material of the side-belt portion 24, a highly breathable mesh material such as polyester or nylon may be used, or a highly stretchable material such as spandex may be used.

The shoulder strap portion 26 is mainly constituted by a pair of straps that each connect an upper end of the cup portion 22 and an upper end on the back side of the side-belt portion 24, over a shoulder of the wearer 10. Each of the pair of straps constituting the shoulder strap portion 26 is configured to connect the left or right upper end of the cup portion 22 and the left or right upper end of the side-belt portion 24, over the left or right shoulder and through the vicinity of the left or right shoulder blade of the wearer 10.

In a modification, the shoulder strap portion 26 need not necessarily be constituted by two straps and may be constituted by three or more straps. Alternatively, a single shoulder strap may be formed to connect the left upper end and the right upper end of the cup portion 22 through the back side of the neck of the wearer 10. The shoulder straps may be formed to connect to, instead of the side-belt portion 24, a fabric supporting the back of the wearer 10. In another modification, the shoulder straps may be omitted by attaching upper parts of the cup portion 22 to upper parts of the breasts of the wearer 10. Also, as illustrated, some or all of the portions may be connected with each other by sewing, thereby forming the brassiere. In a modification, the materials of the portions of the brassiere 20 may be woven together without sewing, thereby integrally forming the brassiere 20. Such a modification will be described with reference to the next figure.

Figure 3:
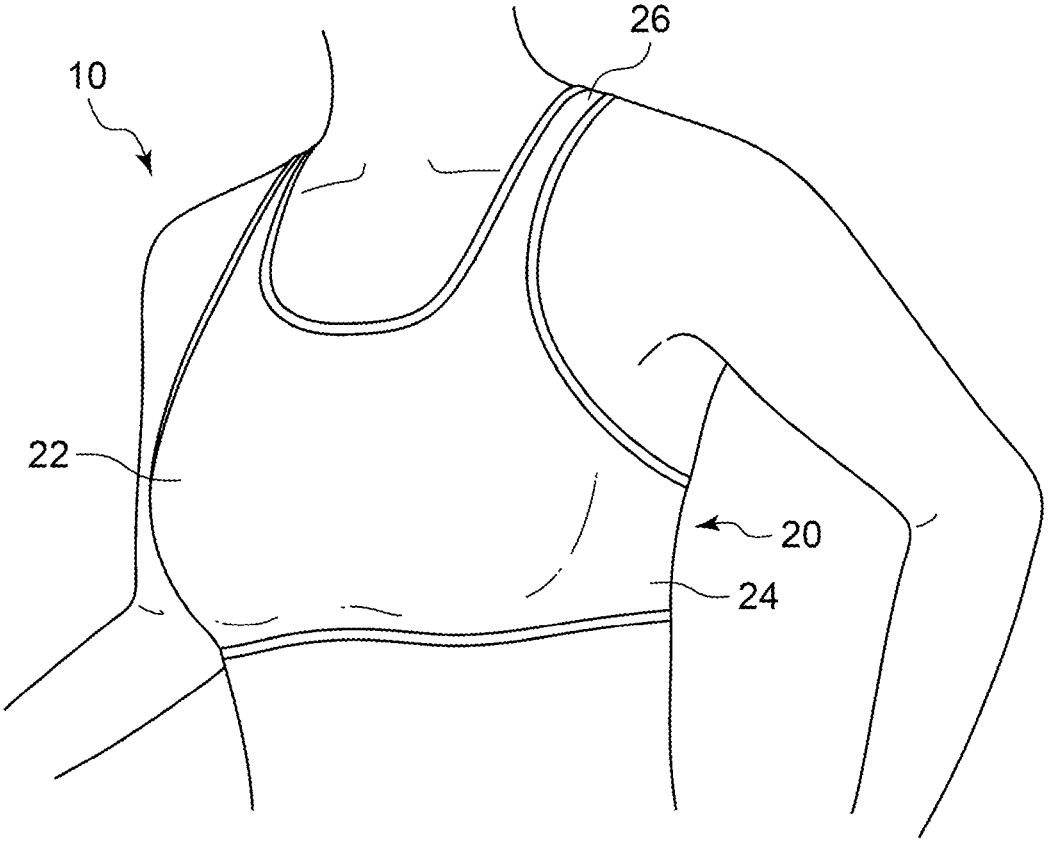
FIG. 3 is a perspective view of a worn state of a brassiere in a modification, viewed from the front left side.
Figure 4:
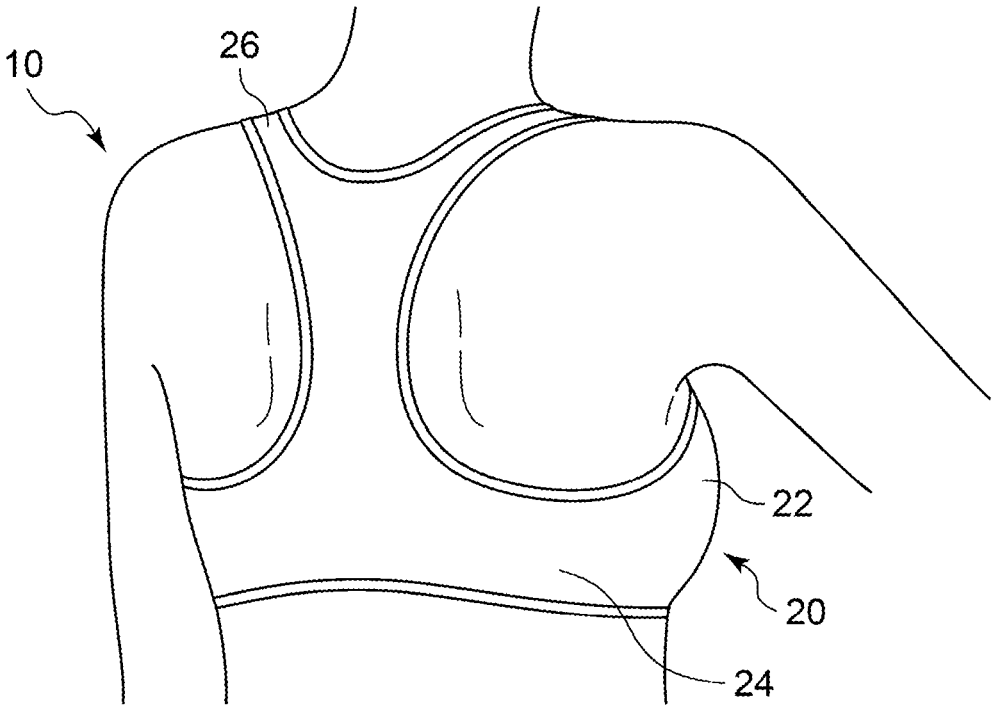
FIG. 4 is a perspective view of a worn state of the brassiere in the modification, viewed from the rear right side.

FIG. 3 is a perspective view of a worn state of the brassiere 20 in a modification, viewed from the front left side. FIG. 4 is a perspective view of a worn state of the brassiere 20 in the modification, viewed from the rear right side. The brassiere 20 in the modification is integrally formed by the materials of the cup portion 22, side-belt portion 24, and shoulder strap portion 26 without sewing. However, the portions are separately referred to, from a functional point of view. When the brassiere 20 is integrally formed, differences in stretchability in the length and circumferential directions may be made in the areas occupied by the portions including the cup portion 22, side-belt portion 24, and shoulder strap portion 26, by using the differences in the weave of the fabric, the fiber direction, the amount of fiber used, and the like, and also by applying resin or the like to the fiber, for example.

Figure 5:
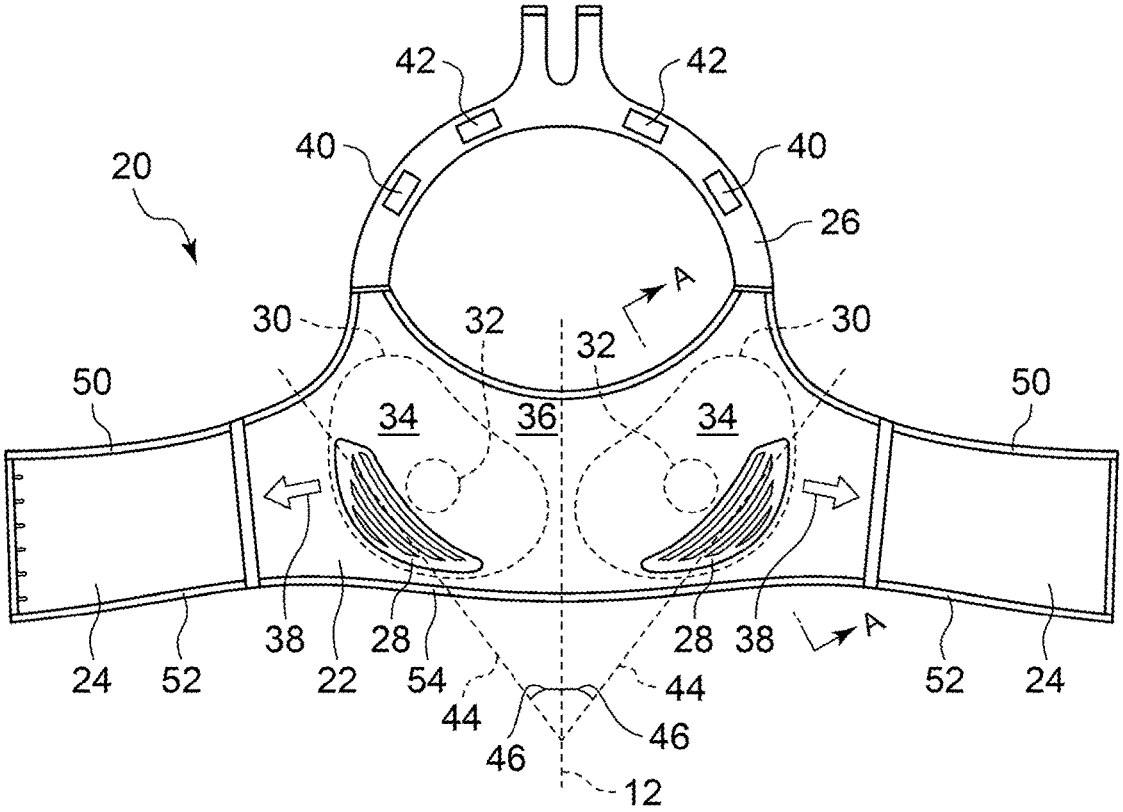
FIG. 5 illustrates the back surface of the brassiere.

FIG. 5 illustrates the back surface of the brassiere 20. The cup portion 22 has on its back or inner surface a pair of cup-shaped curved surfaces facing the breasts of the wearer 10. The areas where the cup-shaped curved surfaces are provided are illustrated as circular regions 30. Each circular region 30 corresponds to a position where a breast fits when the brassiere 20 is worn, and the dotted line indicating the circular region 30 may be a line corresponding to the outer circle of the breast. The lower half of the dotted line indicating a circular region 30 may be a line corresponding to the barge scan line, which is the boundary between the lower part of the breast and the body. Each circular region 30 need not necessarily be a true circular region and may be an oval or a bean-shaped region that follows an average breast outer circle shape. The vertical dotted line shown in the center of the brassiere 20 is a line that overlaps the midline of the wearer 10 when the wearer 10 wears the brassiere 20 (hereinafter, referred to as the midline 12).

In each of the pair of cup-shaped portions, an adhesive member 28 is disposed in a peripheral region 34 excluding a central portion 32 of the circular region 30 facing a breast, with an arrangement pattern for restraining movement of the breast toward the lower side and the side and movement of the breast on the lower side and the side. When viewed from the left and right central portions 32, the sides on which the left and right side-belt portions 24 are located are called the "sides", and directions 38 from the central portions 32 toward the side-belt portions 24 are called the "side" directions. The same material or different materials may be used for the circular regions 30 and an outside-circle region 36, which is a portion other than the circular regions 30. By excluding the central portions 32 from the regions where the adhesive members 28 are provided, sticking of the adhesive members 28 to the nipples can be prevented.

Each adhesive member 28 is formed, for example, by applying, such as to form a film shape, an adhesive soft synthetic resin, such as silicone, polyurethane, or elastomer, to a cup-shaped curved surface on the back or inner surface of the cup portion 22. Each adhesive member 28 in a modification may be formed by attaching an adhesive synthetic resin processed in advance into a film shape, to a cup-shaped curved surface on the back or inner surface of the cup portion 22, with a predetermined arrangement pattern.

The arrangement pattern of an adhesive member 28 is a pattern with which the adhesive member 28 is disposed along a diagonal region from below the central portion 32 toward an upper part of the side, on one of the pair of cup-shaped curved surfaces facing the breasts in the cup portion 22. The arrangement pattern of an adhesive member 28 may be a pattern forming multiple parallel straight lines when the brassiere is placed flat. However, since the adhesive member 28 is actually disposed on a cup-shaped curved surface, FIG. 5 illustrates multiple parallel curves. The pattern of multiple parallel curves is similar to contour lines of a breast. When an adhesive member 28 is disposed to form multiple diagonal lines, slits are formed between the diagonal lines.

The slits are structures for efficiently releasing moisture such as sweat to the fabric of the cup portion 22 during perspiration due to exercise and improving breathability. In this respect, as a structure suitable for sweat measures in a sports brassiere, each adhesive member 28 is provided in an arrangement pattern forming the slits, unlike a strapless brassiere, which is mainly used for dress-up, with an adhesive material applied entirely over the inner surface of its cup portion. Also, since the slits are provided in the arrangement pattern of the adhesive member 28, the area, volume, and weight of the adhesive member 28 can be reduced compared to the case where the adhesive member is applied to the entire surface. Reducing the area of the adhesive member 28 leads to the corresponding region's getting less sweaty. Also, reducing the volume and weight of the adhesive member 28 leads to feeling the brassiere 20 itself lighter.

Of the pair of left and right adhesive members 28, the right adhesive member 28 is disposed diagonally toward the upper right, and the left adhesive member 28 is disposed diagonally toward the upper left. Each adhesive member 28 is disposed along a pattern line 44 in FIG. 5. A pair of left and right pattern lines 44 are dotted diagonal lines that each form a predetermined angle with respect to the midline 12. A pattern angle 46 formed by a pattern line 44 and the midline 12 is, for example, 30 to 60 degrees. When an adhesive member 28 is disposed along the corresponding pattern line 44, the adhesive member 28 corresponds to a region inclined from below the central portion 32 toward the upper part of the side, at an angle in the range of 30 to 60 degrees with respect to the midline 12. The numerical values of 30 to 60 degrees are not required to be exact and also include values around 30 degrees and around 60 degrees; this means that it will be sufficient if the angle falls almost within the range of 30 to 60 degrees.

The adhesive force of the adhesive members 28 may be, for example, 0.3 to 0.8 N/20 mm. The values of 0.3 to 0.8 N/20 mm are numerical values obtained in an adhesion test using a 180-degree peel adhesion measuring device, as a result of testing a sample while moving the chuck at 50 mm/minute. With such adhesive force, the adhesive members 28 moderately adhere to the skin of the breasts. A portion of each adhesive member 28 located below the central portion 32 restrains downward swaying of the breast, and a portion of the adhesive member 28 located closer to the side than the central portion 32 restrains swaying of the breast toward the side.

On the surface of each adhesive member 28, embossing is performed to provide fine asperities. With such asperities on the surface of each adhesive member 28, moisture such as sweat of the wearer 10 can be effectively released. Also, by increasing the friction coefficient with the fine asperities, slippage due to moisture such as sweat of the wearer 10 on the surface of each adhesive member 28 can be restrained.

The side-belt portion 24 and the cup portion 22 are formed such that the contraction force in a chest circumference direction at an upper edge 50 of the side-belt portion 24 is equal to the contraction force in a chest circumference direction at a lower edge 52 of the side-belt portion 24 and a lower edge 54 of the cup portion 22. The contraction force at the upper edge 50 of the side-belt portion 24 being equal to the contraction force at the lower edge 52 of the side-belt portion 24 and the lower edge 54 of the cup portion 22 means that, without a highly elastic underbelt, the cup portion 22 and the side-belt portion 24 can be held tight enough on the chest of the wearer 10. In general, due to its high elasticity, the underbelt causes a feeling of stronger tightness for the wearer and is also likely to cause a feeling of suffocation especially during exercise with cardiopulmonary load. In the brassiere 20 of the first embodiment, even without the underbelt, the cup portion 22 can be sufficiently held on the chest of the wearer 10 by the adhesive members 28, and, with the uniform contraction force in the upper and lower parts of the side-belt portion 24, the brassiere 20 can be also sufficiently held around the chest of the wearer 10. In a modification, an underbelt may be provided in a lower part of the cup portion 22 and the side-belt portion 24 of the brassiere 20. In this case, the contraction force of the underbelt need not be as high as a conventional product, and contraction force with which the position can be moderately kept or slightly loose contraction force will be sufficient. Further, an adhesive member may be provided also on the underbelt to keep moderate compression on the chest.

In the shoulder strap portion 26, shoulder adhesive members 40 are arranged on the portions respectively facing upper parts of the shoulders of the wearer 10. Also, in the shoulder strap portion 26, shoulder blade adhesive members 42 are arranged on the portions respectively facing middle parts of the shoulder blades of the wearer 10. The shoulder adhesive members 40 and the shoulder blade adhesive members 42 may be formed of a highly adhesive synthetic resin similar to the adhesive members 28, and embossing may be performed on the surfaces thereof. Also, in order to release sweat, improve breathability, and reduce weight, each of the shoulder adhesive members 40 and the shoulder blade adhesive members 42 may be provided in an arrangement pattern in which slits are partially provided.

In a modification, either the shoulder adhesive members 40 or the shoulder blade adhesive members 42 or the both may not be provided, and the shoulder strap portion 26 itself may be formed of a viscoelastic member so that the shoulder strap portion 26 adheres to upper parts of the shoulders and middle parts of the shoulder blades of the wearer 10. As the viscoelastic member, a synthetic resin such as rubber may be used, for example.

An A-A end surface cut to intersect a pattern line 44 perpendicularly or at a near-perpendicular angle will be described with reference to the next figure.

Figure 6:
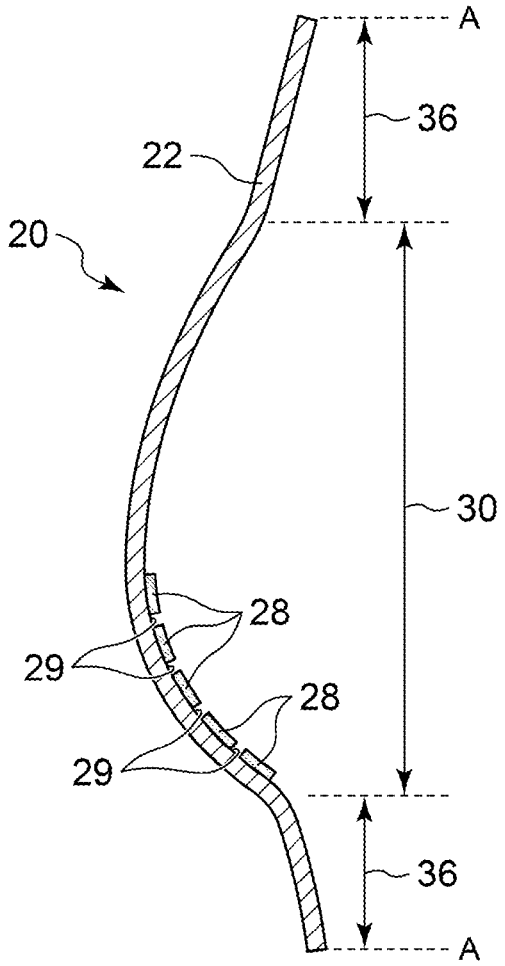
FIG. 6 schematically shows an A-A end surface.

FIG. 6 schematically shows the A-A end surface. In the A-A end surface of the cup portion 22, about ¼ from each of the left and right ends is the outside-circle region 36, and a region sandwiched between the outside-circle regions 36 at the left and right ends is a circular region 30 formed on a cup-shaped curved surface. On the A-A end surface, the adhesive member 28 is disposed in approximately the lower half of the circular region 30. The adhesive member 28 is formed with an arrangement pattern of multiple lines or thin strips, and slits 29 are formed between the linear or thin strip-like adhesive members. Through the slits 29, not only moisture such as sweat can be released to the cup portion 22 side, but also ventilation can be improved through the fabric of the cup portion 22. Each adhesive member 28 is thinner than the fabric of the cup portion 22 and may have a film shape.

Figure 7:
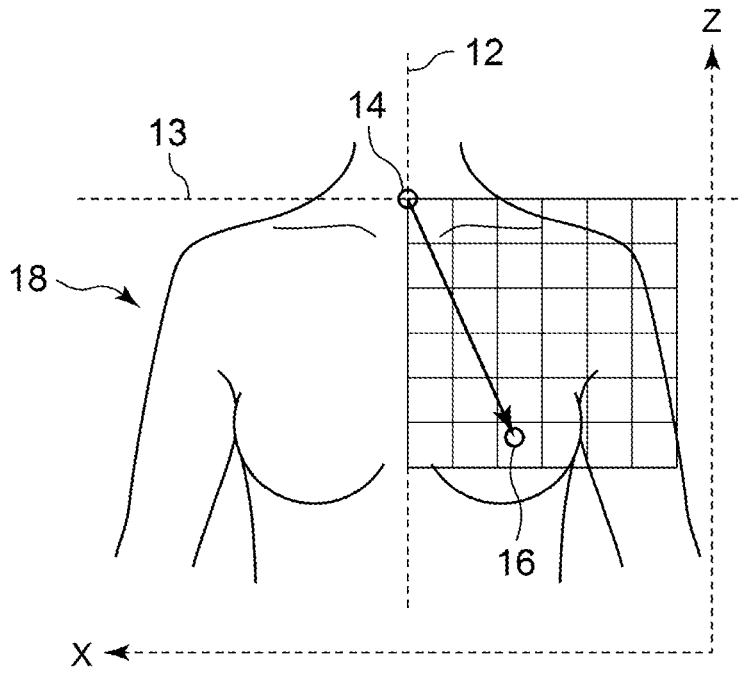
FIG. 7 shows a standard for measuring the behavior of a nipple during running.

FIG. 7 shows a standard for measuring the behavior of a nipple during running. The behavior of a nipple during running under nude conditions, i.e., without wearing a brassiere, was measured in a test. In this test, a trajectory of a relative position of a nipple 16 of a subject 18 is obtained in the form of position coordinates, in which the reference point is set to a clavicle center point 14, which is the intersection of the midline 12 and a clavicle line 13 indicating the clavicle position of the subject 18. The horizontal axis of the illustrated coordinates is the X-axis that indicates a horizontal direction of a horizontal plane, and the vertical axis is the Z-axis that indicates a vertical direction.

Figure 8:
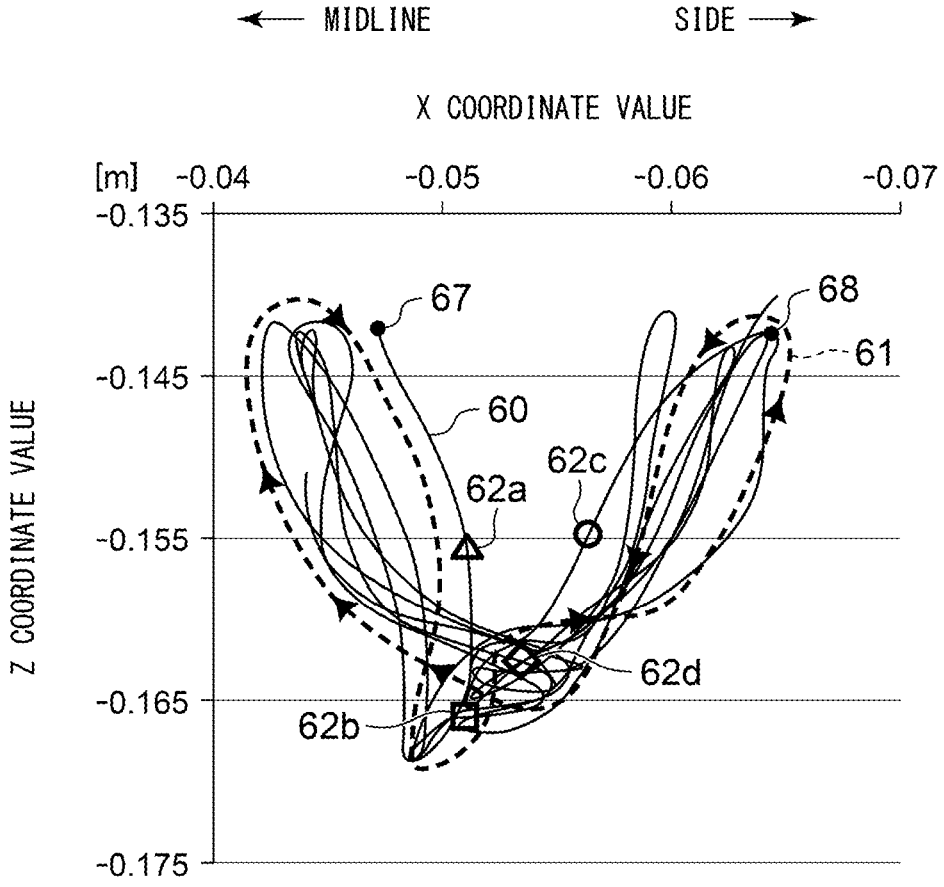
FIG. 8 shows a trajectory of a nipple during running.
Figure 9:
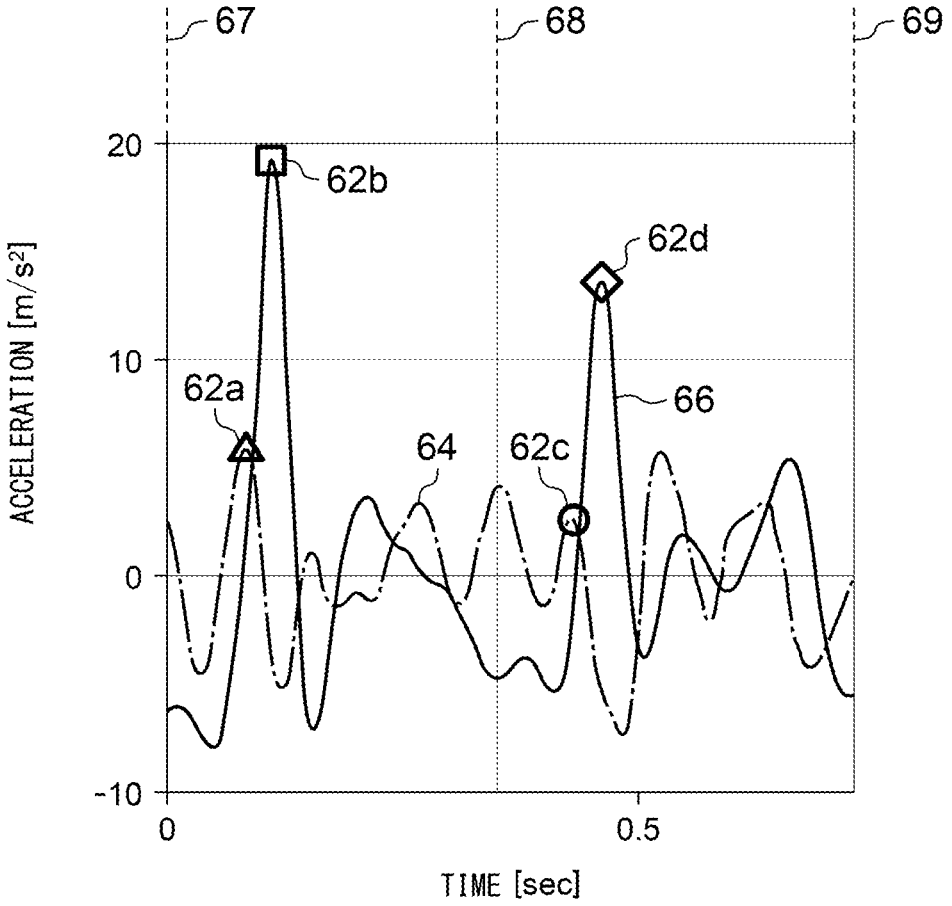
FIG. 9 shows acceleration of nipple displacement during running.

FIG. 8 shows a trajectory of a nipple during running. FIG. 9 shows acceleration of nipple displacement during running. The graph of FIG. 8 shows the result of measuring the displacement trajectory of the left breast nipple of the subject 18 during running under nude conditions, and the graph of FIG. 9 shows the result of measuring the displacement acceleration in the displacement trajectory. In the graph of FIG. 8, the trajectory of the nipple 16 of the subject 18 is indicated by a trajectory line 60, with the clavicle center point 14 set as the reference point, the Z-axis coordinate values indicated on the vertical axis, and the X-axis coordinate values indicated on the horizontal axis. As illustrated, the trajectory line 60 as the measurement result is not a linear trajectory but shows a trajectory that looks like a distorted numeral "8". In the graph of FIG. 9, the values of displacement acceleration in the X-axis direction or Z-axis direction are indicated on the vertical axis, and the time values are indicated on the horizontal axis. The left end of the graph of FIG. 9 indicates a right foot ground contact time point 67, the middle of the graph indicates a left foot ground contact time point 68, and the right end of the graph indicates a right foot ground contact time point 69. As shown in FIG. 9, a waveform 64, which indicates acceleration on the X-axis, has a shape of an alternating waveform of which the amplitude is not constant, and a waveform 66, which indicates acceleration on the Z-axis, also has a shape of an alternating waveform of which the amplitude is not constant. The amplitudes and periods of these waveforms vary depending on the running form, speed, physical characteristics, and the like of the subject 18.

The trajectory line 60 shown in FIG. 8 shows a trajectory in a direction as indicated by a dotted arrow 61. At the right foot ground contact time point 67, the left breast nipple is positioned near an upper part on the midline side and then moves downward after the ground contact of the right foot. At a first time point 62*a*, the displacement acceleration in the X-axis direction shows a peak value in the positive direction, as shown in FIG. 9. Also, at a second time point 62*b* shown near the lowest point, the displacement acceleration in the Z-axis direction shows a peak value, as shown in FIG. 9. From the lowest point, the nipple moves upward and toward the side and then reverses at the left foot ground contact time point 68 located near the highest point on the side. From near the left foot ground contact time point 68, the nipple moves downward and toward the midline. At a third time point 62*c*, the displacement acceleration in the X-axis direction shows a peak value in the positive direction, as shown in FIG. 9. Also, at a fourth time point 62*d*, the displacement acceleration in the Z-axis direction shows a peak value, as shown in FIG. 9. Thereafter, the nipple reverses at the lowest point and moves upward, and the trajectory line 60 makes a circuit near the right foot ground contact time point 67. Thus, the swaying of the breasts during running is particularly large when the breasts move downward or are positioned on the lower side or on the sides, and it is considered that such large swaying causes impact to the soft tissues of the breasts and a feeling of sway. Therefore, by restraining such movement, the swaying is efficiently restrained.

Figure 10:
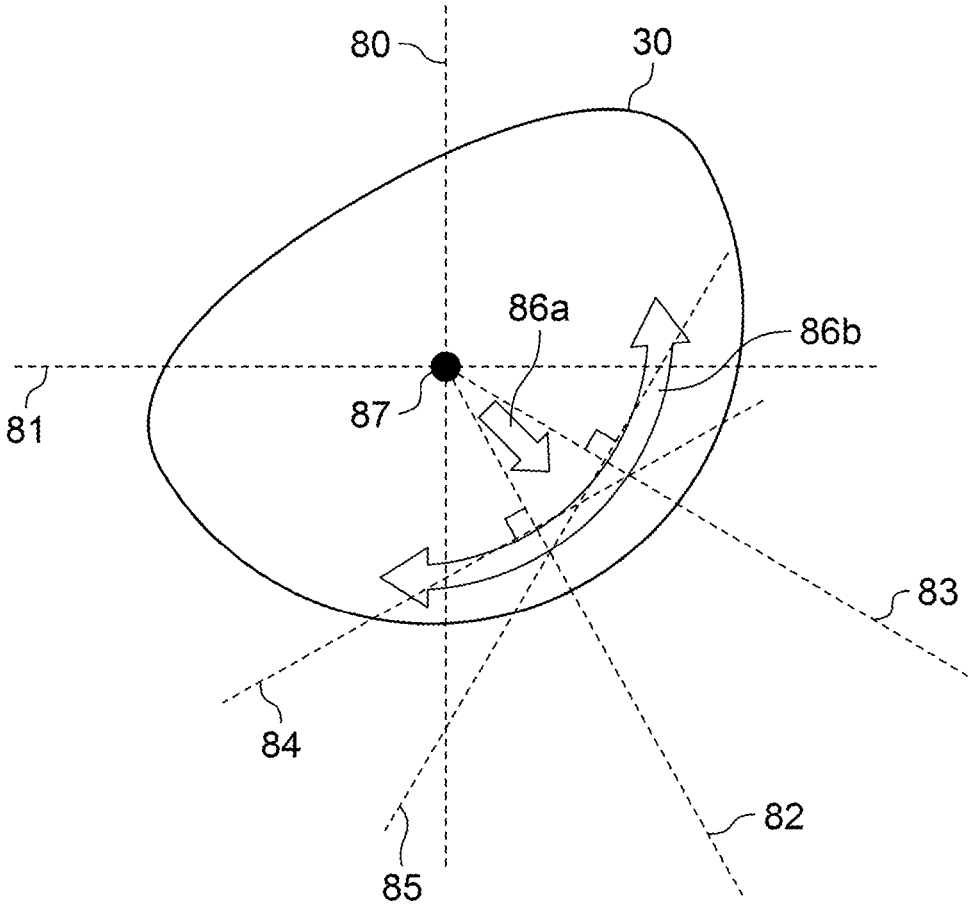
FIG. 10 shows a relationship between the direction of nipple displacement and the angle of an adhesive member.

FIG. 10 shows a relationship between the direction of nipple displacement and the angle of an adhesive member. As described above, the directions in which the swaying of a nipple is particularly large are movement of swaying toward the lower side and the side from the normal position, and movement of swaying at a position closer to the lower side and the side than the normal position. The movement of swaying toward the lower side and the side is illustrated as diagonally downward movement as indicated by a first arrow 86*a*, from the center point 87 of the circular region 30. That is, with respect to a vertical virtual line 80 (dotted line parallel to the midline 12) or a horizontal virtual line 81 (dotted line perpendicular to the midline 12) passing through the center point 87, displacement in the range of 30 to 60 degrees, indicated by a first angle line 82 and a second angle line 83, is large. To effectively restrain this movement, by disposing an adhesive member 28 along a diagonal line included in the range between a third angle line 84 perpendicular to the first angle line 82 and a fourth angle line 85 perpendicular to the second angle line 83, the movement of the breast can be effectively restrained. Meanwhile, the acceleration of curved or diagonal swaying at a position closer to the lower side and the side than the normal position is illustrated as movement as indicated by a second arrow 86*b*, which is a circular arc of about a quarter circle connecting a position closer to the lower side and a position closer to the side with respect to the center point 87 of the circular region 30. That is, with respect to the vertical virtual line 80 (dotted line parallel to the midline 12) or the horizontal virtual line 81 (dotted line perpendicular to the midline 12) passing through the center point 87, curved or linear displacement along the range of 30 to 60 degrees indicated by the third angle line 84 and the fourth angle line 85 is large. To effectively restrain this movement, by disposing the adhesive member 28 almost along the third angle line 84 and the fourth angle line 85, the movement of the breast can be effectively restrained.

Figure 11:
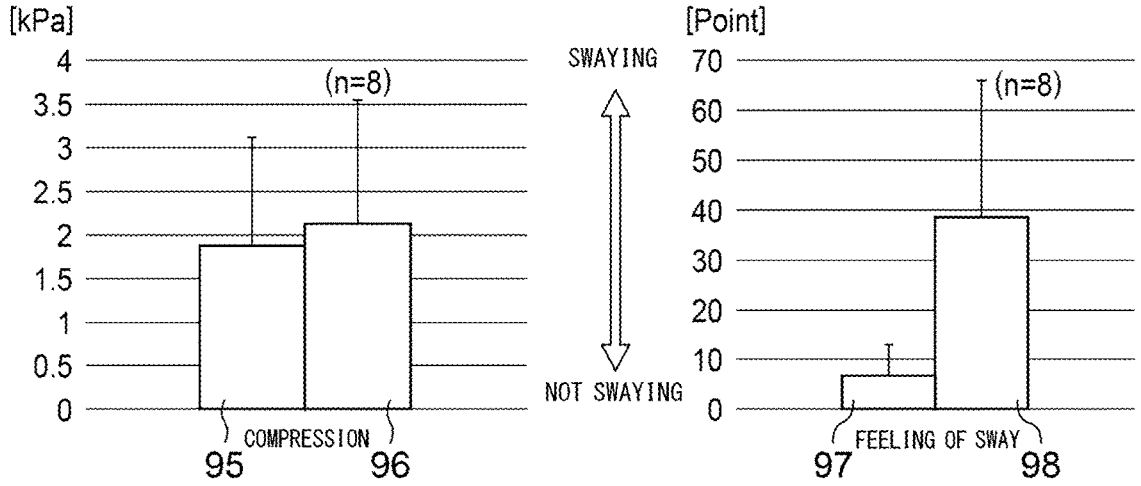
FIG. 11 shows results of evaluating differences in compression and a feeling of sway between with and without adhesive members.

FIG. 11 shows results of evaluating differences in compression and a feeling of sway between with and without the adhesive members. The graphs in FIG. 11 show the evaluation results of the same sports brassieres worn and compared by the same subject, which differ only in the presence or absence of the adhesive members. In the left graph, the difference in value is small between a bar graph 95, which shows compression with the sports brassiere with the adhesive members, and a bar graph 96, which shows compression with the sports brassiere without the adhesive members. Therefore, no significant change in compression due to the presence or absence of the adhesive members was observed. On the other hand, in the right graph, the difference in value is large between a bar graph 97, which shows a feeling of sway with the sports brassiere with the adhesive members, and a bar graph 98, which shows a feeling of sway with the sports brassiere without the adhesive members. Therefore, a significant change in a feeling of sway due to the presence or absence of the adhesive members was observed, and it was found that a feeling of sway was improved by the adhesive members.

Figure 12:
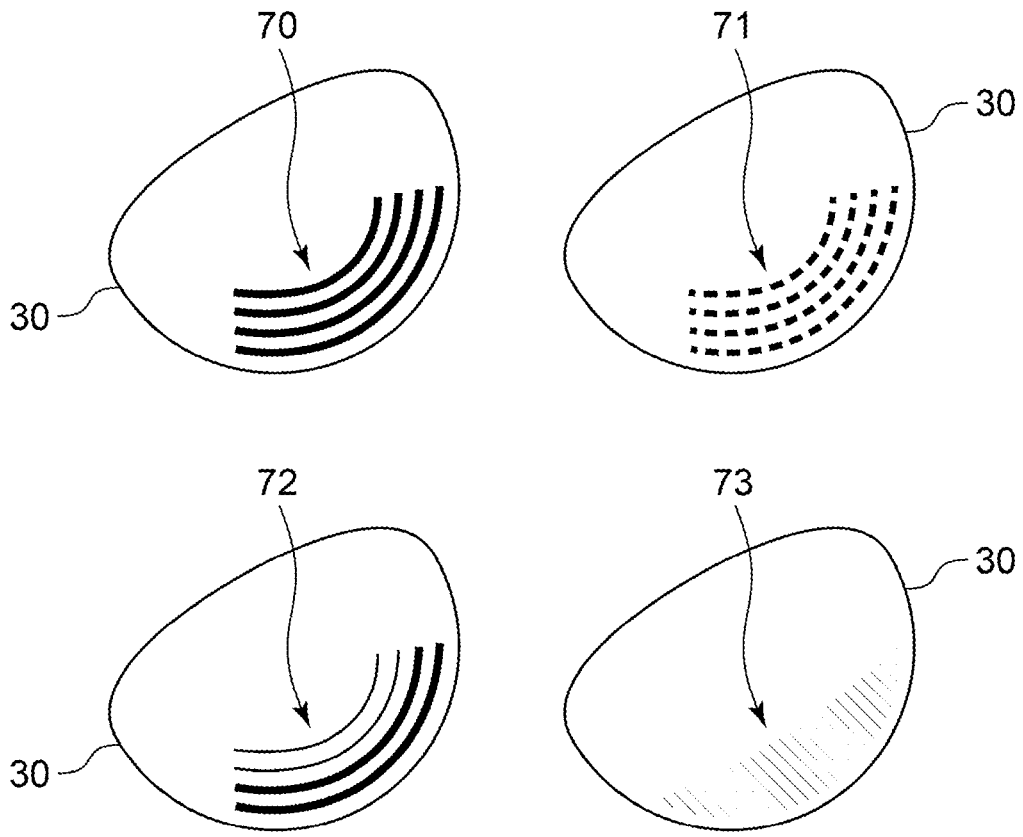
FIG. 12 shows first through fourth modifications of the arrangement pattern of an adhesive member.

FIG. 12 shows first through fourth modifications of the arrangement pattern of an adhesive member 28. An arrangement pattern 70 of an adhesive member 28 in the first modification is a pattern formed by multiple (e.g., four) parallel band-shaped curves. Since the parallel band-shaped curves in the arrangement pattern 70 of the first modification form a shape similar to contour lines of a breast, with which swaying of the breast can be restrained easily, it is considered that the effect of restraining swaying of the breast is relatively high.

An arrangement pattern 71 of an adhesive member 28 in the second modification is a pattern formed by multiple (e.g., four) parallel dotted curves. An arrangement pattern 72 of an adhesive member 28 in the third modification is a pattern formed by multiple (e.g., four) parallel band-shaped curves of which the thicknesses are not uniform. An arrangement pattern 73 of an adhesive member 28 in the fourth modification is a pattern formed by a large number of diagonal lines parallel to a direction from the center of the circular region 30 toward the lower side on the side. The pattern of a large number of parallel diagonal lines may be a pattern of dotted lines.

When the arrangement pattern 70 of the first modification is compared with the arrangement patterns 71, 72, and 73 of the second through fourth modifications, the arrangement pattern 70 of the first modification may be superior in the function of restraining swaying, while the arrangement patterns 71, 72, and 73 are considered to be superior in the function for sweat measures. It is considered that, since each of the arrangement patterns 71, 72, and 73 includes a smaller amount of adhesive members or a shorter continuous area of adhesive members than the arrangement pattern 70, the contact area between the fabric and the skin is larger than that in the arrangement pattern 70, and the efficiency of adsorbing sweat by the fabric or discharging sweat through the slits between the adhesive members is higher than that in the arrangement pattern 70.

In each of the arrangement patterns 71 and 73, the shape of a dot included in the dotted pattern may be a geometric shape, such as a circle or a triangle. In each of the arrangement patterns 70, 71, 72, and 73, the pattern of curves may be formed by solid lines, dotted lines, or wavy lines. In the case of wavy lines, they may be sinusoidal wave lines, triangular wave lines, or square wave lines.

Figure 13:
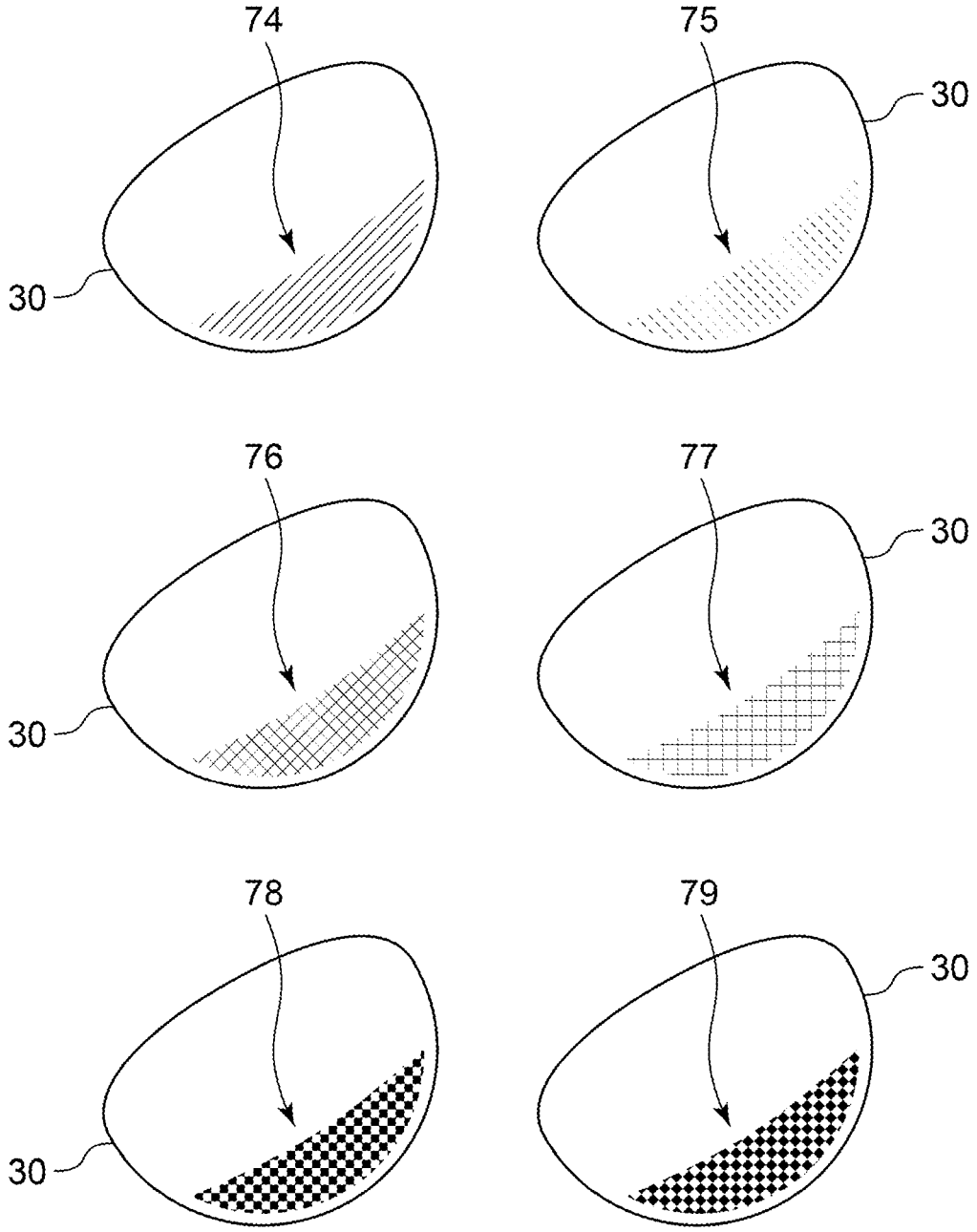
FIG. 13 shows fifth through tenth modifications of the arrangement pattern of an adhesive member.

FIG. 13 shows fifth through tenth modifications of the arrangement pattern of an adhesive member 28. An arrangement pattern 74 of an adhesive member 28 in the fifth modification is a fine stripe pattern. An arrangement pattern 75 of an adhesive member 28 in the sixth modification is a fine wavy line pattern. An arrangement pattern 76 of an adhesive member 28 in the seventh modification is a fine diagonal mesh pattern. An arrangement pattern 77 of an adhesive member 28 in the eighth modification is a coarse horizontal mesh pattern. An arrangement pattern 78 of an adhesive member 28 in the ninth modification is a fine checkered pattern. An arrangement pattern 79 of an adhesive member 28 in the tenth modification is a coarse inclined checkered pattern.

Figure 14:
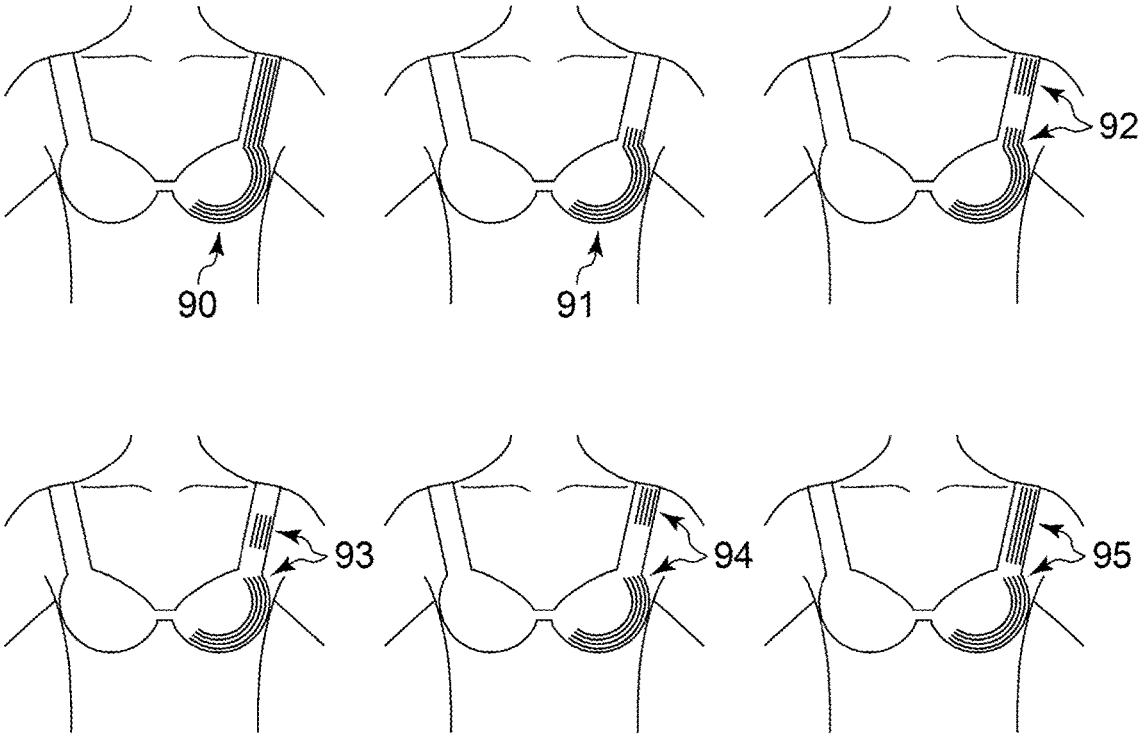
FIG. 14 shows eleventh through sixteenth modifications of the arrangement pattern of an adhesive member.

FIG. 14 shows eleventh through sixteenth modifications of the arrangement pattern of an adhesive member 28. In the eleventh through sixteenth modifications, the adhesive member 28 is disposed also on a portion other than the cup portion 22. An arrangement pattern 90 of an adhesive member 28 in the eleventh modification is a pattern in which the adhesive member 28 is disposed not only along the outer circle of the cup portion 22 from a lower part to the side, but also continuously to an upper part of the side and to an upper part of the shoulder in the shoulder strap portion 26. An arrangement pattern 91 of an adhesive member 28 in the twelfth modification is a pattern in which the adhesive member 28 is disposed along the outer circle of the cup portion 22 from a lower part to the side and continuously to an upper part of the side and to a lower part of the shoulder strap portion 26. An arrangement pattern 92 of an adhesive member 28 in the thirteenth modification is a pattern in which, in addition to the arrangement pattern 91, the adhesive member 28 is also disposed separately in an upper part of the shoulder strap portion 26.

An arrangement pattern 93 of an adhesive member 28 in the fourteenth modification is a pattern in which, in addition to the arrangement pattern 91, the adhesive member 28 is also disposed separately in a middle part on the front side of the shoulder strap portion 26. An arrangement pattern 94 of an adhesive member 28 in the fifteenth modification is a pattern in which the adhesive member 28 is disposed separately in a portion along the outer circle of the cup portion 22 from a lower part to the side and also to an upper part of the side and in a portion of an upper part of the shoulder strap portion 26. An arrangement pattern 95 of an adhesive member 28 in the sixteenth modification is a pattern in which the adhesive member 28 is disposed separately in a portion along the outer circle of the cup portion 22 from a lower part to the side and also to an upper part of the side and in the entire shoulder strap portion 26.

Figure 15:
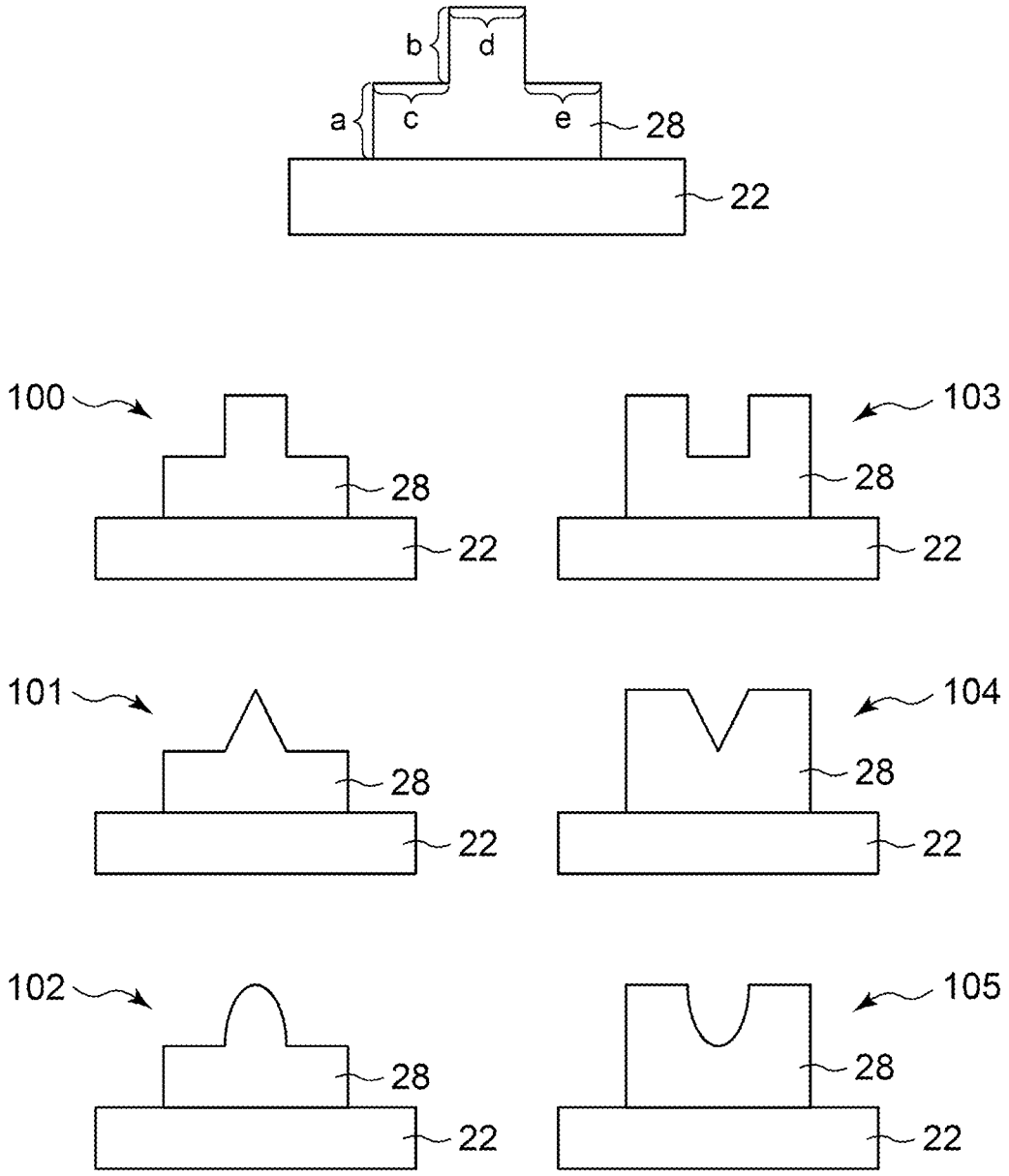
FIG. 15 illustrates examples of a cross-sectional shape of an embossing pattern applied to the surface of an adhesive member.

FIG. 15 illustrates examples of a cross-sectional shape of an embossing pattern applied to the surface of an adhesive member. The cross-sectional shapes of embossing mainly include a convex type and a concave type, of which the cross-sectional shapes of the convex and concave portions are each formed to have a geometric shape, such as a square, a triangle, and an ellipse. For example, a condition of sides a, b, c, d, and e in a convex-type cross section may be none of the values of the sides being zero.

For example, in a first example 100 of the convex-type cross section, the convex shape is a square. In a second example 101 of the convex-type cross section, the convex shape is a triangle. In a third example 102 of the convex-type cross section, the convex shape is an ellipse. Also, for example, in a first example 103 of the concave-type cross section, the concave shape is a square. In a second example 104 of the concave-type cross section, the concave shape is a triangle. In a third example 105 of the concave-type cross section, the concave shape is an ellipse.

Figure 16:
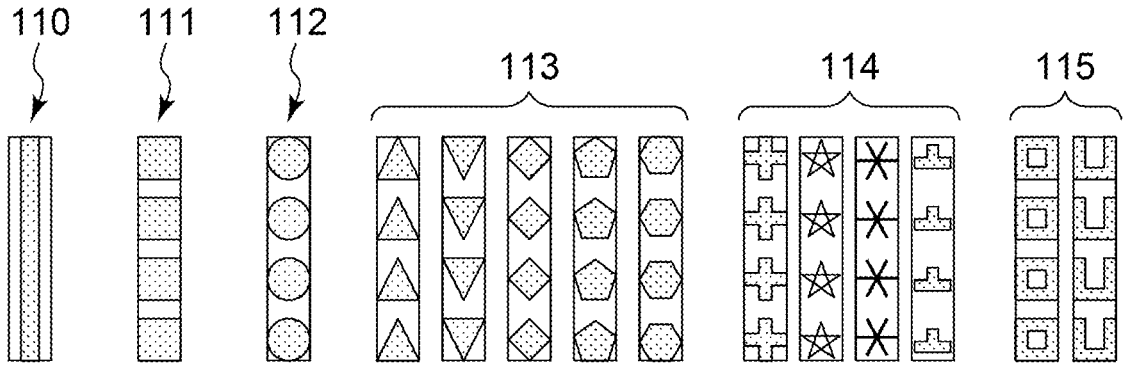
FIG. 16 illustrates examples of a planar shape of an embossing pattern applied to the surface of an adhesive member.

FIG. 16 illustrates examples of a planar shape of an embossing pattern applied to the surface of an adhesive member. As the planar shapes of embossing, the shapes of the convex and concave portions in the pattern cross-sectional shapes in plan view include various shapes. In the following, examples of the planar shape of a convex or concave portion will be described.

The planar shape in a first example 110 has a form of a continuous line, and the planar shape in each of a second example 111 and a third example 112 has a form of a dotted line in which objects are intermittently arranged at regular or irregular intervals. The planar shape in the second example 111 is a pattern in which squares are intermittently arranged, and the planar shape in the third example 112 is a pattern in which circles are intermittently arranged. The planar shapes in a fourth example 113 are patterns in which various arbitrary polygons are intermittently arranged at regular or irregular intervals. An arbitrary polygon may be, for example, a triangle, an inverted triangle, a rhombus, a pentagon, or a hexagon, which may not be a regular polygon, and may be arranged at a position rotated by an arbitrary angle. Also, it is not limited to a polygon and may be a figure of a corporate logo.

The planar shapes in a fifth example 114 are configured by diagonals of various arbitrary polygons. An arbitrary polygon may be, for example, a triangle, an inverted triangle, a rhombus, a pentagon, or a hexagon, which may not be a regular polygon, and may be arranged at a position rotated by an arbitrary angle. As a diagonal, the line may be partially omitted, and the thickness of the line may be arbitrary. Each of the planar shapes in a sixth example 115 is a figure obtained by holing any of the figures shown in the first example 110 through the fifth example 114 or a figure obtained by omitting one or some of the sides of the holed figure.

The present disclosure has been described based on an embodiment. The embodiment is intended to be illustrative only, and it will be obvious to those skilled in the art that various modifications to a combination of constituting elements or processes could be developed and that such modifications also fall within the scope of the present disclosure. Also, when the embodiment set forth above is generalized, the following aspects are obtained.

Aspect 1

A sports brassiere, including:

a cup portion that covers breasts of a wearer;

a side-belt portion that connects outer ends of the cup portion in a chest circumference direction of the wearer; and a shoulder strap portion that connects an upper end of the cup portion and an upper end of the side-belt portion over a shoulder of the wearer, wherein, on a surface of the cup portion that faces the breasts, an adhesive member is disposed in a peripheral region excluding a central portion of a circular region facing a breast, with an arrangement pattern for restraining movement of the breast on a lower side and a side.

Aspect 2

The sports brassiere according to Aspect 1, wherein the arrangement pattern is a pattern with which an adhesive member is disposed along a diagonal region from below the central portion toward an upper part of a side, on the surface of the cup portion that faces the breasts.

Aspect 3

The sports brassiere according to Aspect 2, wherein the diagonal region is a region inclined from below the central portion toward an upper part of a side, at an angle in the range of 30 to 60 degrees with respect to a midline.

Aspect 4

The sports brassiere according to Aspect 1 or 2, wherein the side-belt portion and the cup portion are formed such that contraction force in a chest circumference direction at an upper edge of the side-belt portion is equal to contraction force in a chest circumference direction at a lower edge of the side-belt portion and a lower edge of the cup portion.

Aspect 5

The sports brassiere according to any one of Aspects 1 through 4, wherein, in the shoulder strap portion, an adhesive member is disposed on a portion facing an upper part of a shoulder of the wearer.

Aspect 6

The sports brassiere according to any one of Aspects 1 through 5, wherein, in the shoulder strap portion, an adhesive member is disposed on a portion facing a middle part of a shoulder blade of the wearer.

Aspect 7

The sports brassiere according to any one of Aspects 1 through 6, wherein the shoulder strap portion is formed of a viscoelastic member.

Aspect 8

The sports brassiere according to any one of Aspects 1 through 7, wherein, on a surface of the adhesive member, embossing is performed.

Aspect 9

The sports brassiere according to any one of Aspects 1 through 8, wherein the adhesive force of the adhesive member is 0.3 to 0.8 N/20 mm.

Aspect 10

A sports brassiere, including:

a cup portion that covers breasts of a wearer; and a side-belt portion that connects outer ends of the cup portion in a chest circumference direction of the wearer, wherein, on a surface of the cup portion that faces the breasts, an adhesive member is disposed along a peripheral region excluding a central portion of a circular region facing a breast, and the peripheral region is a diagonal region located from below the central portion toward an upper part of a side.

What is claimed is:

1. A sports brassiere, comprising:

a cup portion configured to cover breasts of a wearer;

a side-belt portion that connects to outer ends of the cup portion and is configured to cover a left side, a back, and a right side of the wearer;

a shoulder strap portion that connects an upper end of the cup portion and an upper end of the side-belt portion, wherein the shoulder strap portion is configured to extend over a shoulder of the wearer; and an adhesive member disposed, on a surface of the cup portion that is configured to face the breasts, wherein the cup portion comprises a circular region configured to face a breast, wherein the circular region comprises a central portion configured to cover a nipple of the wearer and a peripheral region excluding the central portion, and wherein the adhesive member is disposed only in the peripheral region with an arrangement pattern configured for restraining movement of the breast on a lower side and a side.

2. The sports brassiere according to claim 1, wherein in the arrangement pattern, the adhesive member is disposed in a diagonal region from a part below the central portion toward an upper side part of the peripheral region.

3. The sports brassiere according to claim 2, wherein the diagonal region is a region inclined from the part below the central portion toward the upper side part of the peripheral region, at an angle in the range of 30 to 60 degrees with respect to a midline.

4. The sports brassiere according to claim 1, wherein the side-belt portion and the cup portion are formed such that contraction force in a chest circumference at an upper edge of the side-belt portion is equal to contraction force in the chest circumference at a lower edge of the side-belt portion and a lower edge of the cup portion.

5. The sports brassiere according to claim 2, wherein the side-belt portion and the cup portion are formed such that contraction force in a chest circumference at an upper edge of the side-belt portion is equal to contraction force in the chest circumference at a lower edge of the side-belt portion and a lower edge of the cup portion.

6. The sports brassiere according to claim 1, wherein, in the shoulder strap portion, an additional adhesive member is disposed on a portion configured to face an upper part of a shoulder of the wearer.

7. The sports brassiere according to claim 2, wherein, in the shoulder strap portion, an additional adhesive member is disposed on a portion configured to face an upper part of a shoulder of the wearer.

8. The sports brassiere according to claim 1, wherein, in the shoulder strap portion, an additional adhesive member is disposed on a portion configured to face a middle part of a shoulder blade of the wearer.

9. The sports brassiere according to claim 2, wherein, in the shoulder strap portion, an additional adhesive member is disposed on a portion configured to face a middle part of a shoulder blade of the wearer.

10. The sports brassiere according to claim 1, wherein the shoulder strap portion is formed of a viscoelastic member.

11. The sports brassiere according to claim 2, wherein the shoulder strap portion is formed of a viscoelastic member.

12. The sports brassiere according to claim 1, wherein a surface of the adhesive member comprises an embossing pattern.

13. The sports brassiere according to claim 6, wherein a surface of the additional adhesive member comprises an embossing pattern.

14. The sports brassiere according to claim 7, wherein a surface of the additional adhesive member comprises an embossing pattern.

15. The sports brassiere according to claim 8, wherein a surface of the additional adhesive member comprises an embossing pattern.

16. The sports brassiere according to claim 9, wherein a surface of the additional adhesive member comprises an embossing pattern.

17. The sports brassiere according to claim 1, wherein the adhesive force of the adhesive member is 0.3 to 0.8 N/20 mm.

18. The sports brassiere according to claim 2, wherein the adhesive force of the adhesive member is 0.3 to 0.8 N/20 mm.

19. A sports brassiere, comprising:

a cup portion configured to cover breasts of a wearer;

a side-belt portion that connects to outer ends of the cup portion and is configured to cover a left side, a back, and a right side of the wearer; and an adhesive member disposed, on a surface of the cup portion that is configured to face the breasts, wherein the cup portion comprises a circular region configured to face a breast, wherein the circular region comprises a central portion configured to cover a nipple of the wearer and a peripheral region excluding the central portion, wherein the adhesive member is disposed only in a diagonal region located in the peripheral region, from a part below the central portion toward an upper side part of the peripheral region.

* * * * *